United States Patent [19]

Bondoc et al.

[11] Patent Number: 4,795,661

[45] Date of Patent: Jan. 3, 1989

[54] PROCESS FOR THE MANUFACTURE OF ASPHALT SHINGLES

[75] Inventors: Alfredo A. Bondoc, So. Bound Brook; Duane A. Davis, Plainfield; Stanley P. Frankoski, West Milford; Bruno E. Magnus, Middlesex, all of N.J.

[73] Assignee: GAF Corporation, Wayne, N.J.

[21] Appl. No.: 92,865

[22] Filed: Sep. 3, 1987

Related U.S. Application Data

[62] Division of Ser. No. 829,586, Feb. 14, 1986, Pat. No. 4,717,614.

[51] Int. Cl.[4] ..... B05D 5/00; B05D 1/28; B05D 1/30; B05D 3/12

[52] U.S. Cl. ..... 427/187; 427/210; 427/211; 427/277

[58] Field of Search ..... 427/186, 187, 210, 277, 427/211

[56] References Cited

U.S. PATENT DOCUMENTS

| | | | |
|---|---|---|---|
| 2,099,131 | 11/1937 | Miller | 428/192 |
| 2,150,004 | 3/1939 | MacDonald | 427/186 X |
| 2,559,879 | 7/1951 | Kalin | 427/187 |
| 3,921,358 | 11/1975 | Bettoli | 52/555 |

*Primary Examiner*—Evan Lawrence
*Attorney, Agent, or Firm*—Marilyn J. Maue; Joshua J. Ward

[57] ABSTRACT

A rectangular shingle sheet having a butt portion which is longitudinally divided into spaced apart tab segments and an undivided headlap portion which is 1.3 to 1.5 times higher than the outward extensions of said tab segments in the butt portion; the butt portion and headlap portion carrying an asphaltic backing of varying thickness wherein the upper area of the headlap portion which is of a height approximately equal to that of the butt portion is coated with an asphaltic backing of between about 5 and about 15 mils thickness and the remaining lower area of the headlap portion and the entire butt portion is uniformly coated with an asphaltic backing of between about 20 and about 100 mils thickness. In one embodiment, the shingle is a composite roofing shingle comprising a shingle sheet having a butt portion which is longitudinally divided into spaced apart tab segments, and a separate elongated strip underlying the tab segments which fills the space between the tabs.

A process for the manufacture of the shingles of this invention.

2 Claims, 4 Drawing Sheets

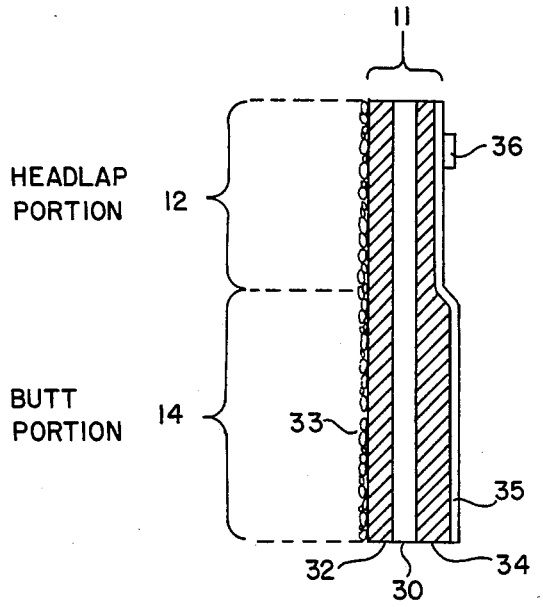
FIG. 3
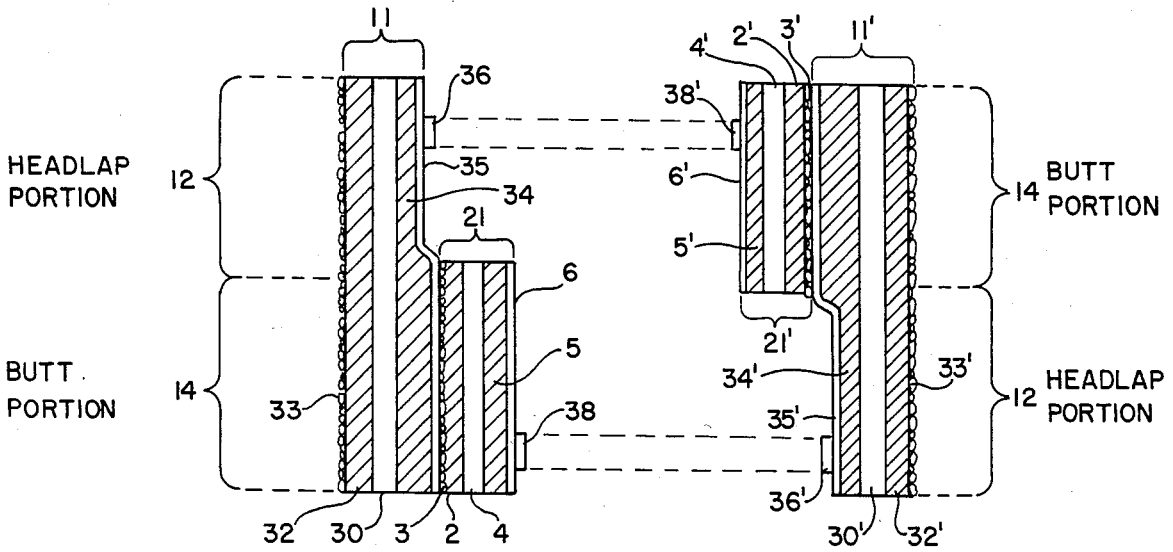
FIG. 3A
FIG. 3B

PROCESS FOR THE MANUFACTURE OF ASPHALT SHINGLES

This is a division of application Ser. No. 829,586, filed Feb. 14, 1986, now U.S. Pat. No. 4,717,614.

In one aspect the invention relates to an improved shingle, particularly a roofing shingle and most particularly to a composite roofing shingle and a roof covering using a plurality of said composite roofing shingles. In a second aspect the invention relates to the manufacture of said shingles.

BACKGROUND OF THE INVENTION

Roofing shingles comprising a fiberglass mat, organic or inorganic felt or fabric stock impregnated and coated with asphalt and covered with colored mineral granules are well known. For the most part, these have served as relatively inexpensive alternatives to tile, slate and wood roofing shingles. Although such asphaltic shingles are fire-resistant, give good protection and are durable, their substantially planar appearance has made them less pleasing to the eye and less imposing than their more expensive counterparts.

Asphalt shingles heretofore available are at a competitive disadvantage with the more expensive roofing shingles because they lack the irregular, bulky horizontal and vertical butt edge profiles and surface contours which are characteristic of roofs of wood or slate shingles Additionally, lighter weight composite shingles having enhanced dimensionality are more desirable for ease of installation and handling.

Many futile prior attempts have been made to provide asphalt shingles which would achieve the substantialy structural and architectural appearance characteristic of wood or slate roofing shingles. For example, the prior art suggests that an asphalt shingle may be endowed with a massive ornamental effect by securing an additional strip beneath closely spaced tabs of a conventional shingle. However, the structure which is obtained, although massive, still provides only the regular, uniform butt edge profile and surface contour which denotes the common asphalt shingle and further adds to the overall shingle weight without any redeeming weathering advantage. It has also been proposed that an asphalt shingle be constructed with a plurality of tongues, the upper ends of which are free and the lower ends of which are integral with the body of the shingle A strip is placed behind the body of the shingle but in front of the tongues which have been fastened to the deck. Such structure provides only a single thickness, uniform butt edge profile and regular, insignificant discontinuities in the surface contour.

In short, the appearance of the prior art asphalt shingle indicated its lower cost. Manufacturers of asphalt shingles have long recognized these problems and have sought to improve the appearance of asphalt shingles by producing them in many colors, and by varying the configuration of the tabs as in U.S. Pat. Nos. 2,194,427; 2,064,473; 2,199,760 and 2,171,010. Attempts have also been made to produce more irregular surface contours as in U.S. Pat. No. 2,099,131 which would give the shingle a bulkier appearance but these efforts have also failed. The goal of producing an inexpensive asphalt shingle which had the physical appearance of the more expensive shingle has until now eluded those skilled in the art.

Accordingly, it is an object of the present invention to overcome the above difficulties and objections and to produce a shingle having markedly increased planar irregularity with substantially no increase in weight by an economical and commercially feasible process.

Another object is to provide a shingle having the above advantages which is pleasing to the eye.

Still another object is to provide a novel process for the production of the present shingles.

These and other objects of the invention will become apparent from the following description and disclosure.

SUMMARY OF THE INVENTION

The present invention involves a rectangular shingle sheet having a butt portion which is longitudinally divided into spaced apart tab segments and an undivided headlap portion which is 1.3 to 1.5 times as high as the outward extension of said tab segments to their butt edge in said butt portion. The butt and headlap portions of the rectangular sheet are coated on their undersurfaces with an asphaltic backing in varying degrees of thickness, wherein the upper area of the headlap portion which is approximately of a height equal to that of the butt portion is coated in a thickness between about 5 and about 15 mils and the remaining lower longitudinal boundary of the headlap portion, where the headlap and butt portions are joined, and the entire butt portion is uniformly coated in a thickness within the range of between about 20 and about 100 mils. It is contemplated that the shingle sheets of the present invention include roofing shingles and siding shingles and may include composite or unitary shingle units.

In general, the shingle sheet comprises a base or substrate sheet of fiberglass mat or asphalt impregnated organic or inorganic felt or felt stock, which, in the case of glass mat has a thickness of between about 10 to 35 mils; and, in the case of a felt, has a thickness of between about 25 and about 95 mils. The upper surface of the substrate carries a substantially uniform layer of asphaltic material in a thickness sufficient to provide a weather resistant, integral coating; usually, between about 15 and about 60 mils uniform thickness, preferably between about 20 and about 50 mils uniform thickness. On this asphaltic surface layer is adhered decorative and protective mineral roofing shingle granules of from about #5 to about #21, preferably from about #7 to about #11 particle size. The decorative granules may be colored to simulate wood, tile or slate surfaces or may be uncolored as derived from natural mineral materials as for example ground slate particles, sand and the like or may be glass or ceramic beads, and may constitute any mixture of colored and uncolored mineral particles to provide a pleasing effect.

The underside and unexposed surface of the base sheet also carries an asphaltic layer; however, the undercoating is deployed in a layer of varying thickness, wherein the butt portion, including the entire tab segments, and a lower area of from about 1/7 to about 3/7 of the headlap portion, from a point where the headlap joins the butt portion, is coated with asphaltic material in a thickness about as great or greater than that on the upper surface of the base sheet and greater than that on the remaining under surface of the headlap portion, e.g. between about 20 and about 100 mils, preferably between about 25 and about 75 mils thickness in the butt area. It is to be understood that the underside coating thickness of individual tab segments in the butt portion can be varied within the above 20 to 100 mils range, if desired for increased irregularity. However, a coating of substantially uniform thickness is more economically produced.

The remaining headlap portion on the undersurface of the base sheet carries an asphaltic coating of reduced thickness, generally a thickness of from about 5 to about 15 mils. It will be realized that the present deployment of undercoating materially reduces the weight of the shingle while increasing surface planar irregularity. Since the unexposed headlap portion need carry only a minimal layer of asphaltic material, this portion of the sheet being adequately protected against weathering by 3–5 overlying asphaltic layers of the overlapping shingle courses after installation, the back coating of the headlap can be reduced to the minimal amount required to maintain shingle integrity. In contrast, the butt portion, which is exposed to the elements carries an undercoating of additional thickness to enhance weathering and to provide elevation of the entire butt portion, thereby substantially increasing the distance between the upper surface of the tab in one course of shingles and the upper surface of tabs in the succeeding overlapping course. The shadow effect derived from the resulting lift of successively overlapping tab sections along all tab borders, particularly along the entire vertical and upper horizontal borders, creates an appearance more pleasing to the eye and more closely simulating the natural wood, tile or slate shingle structure.

The asphaltic material applied as a coating to the upper and under surfaces of the base sheet is generally of a viscosity between about 500 and about 10,000 centipoise, preferably between about 1,000 and about 5,000 centipoise. In accordance with this invention, the minimally coated undersurface of the headlap portion is preferably between about one twentieth and about one fourth the thickness of the butt portion or the remaining 1/7–3/7 area of the adjoining undercoated headlap area. It is most preferred that the thickness of the asphaltic coating on the underside of the butt portion be approximately of the same thickness as that applied on the top or weather surface coating of the shingle sheet so as to provide a balanced butt portion. Such balanced asphaltic coatings minimize ta lift, curl, or distortions which may result from asphaltic shrinkage upon weathering. Suitable asphaltic material includes bitumen, such as asphalt, coal tar pitch, containing 0 to 90 wt. % of mineral stabilizers, fillers or extenders, and any other suitable asphaltic material. Suitable stabilizers and fillers include fine mineral particles, such as for example, powdered limestone, sand, stone dust and other conventional finely divided extenders or low density fillers such as perlite and vermiculite. The asphaltic undercoating of the base sheet carries a back surfacing layer of mineral material on its outer surface, which is a noncementitous material such as mica flakes, talc, sand, and the like or it can be sprayed with relcase agents to render it non-tacky.

For convenience and improved packing and handling procedures in the case of a composite shingle having a shingle sheet as described and a shingle strip underlying the butt portion and at least 1/7th of the headlap portion of the sheet and having its upper and under surfaces coated with asphaltic material where a separate, exposed self-sealing area is applied to the strip under surface, it is recommended that a release strip be affixed longitudinally to the back of the upper headlap area of the shingle sheet so that when individual composite shingles are packed in a flip-flop, back-to-back position, the release strip contacts and overlays the self-sealing areas of the strip, thus preventing the adherence of shingles prior to installation. Suitable sealant materials for the shingle strip include the asphaltic material, petroleum residue, an asphaltic adhesive modified with butyl rubber or any other inexpensive and weather resistant adhesive to which may be added mineral filler, low melt rubber, or plasticizer. The seal release strip which can be employed on the upper headlap under surface of the shingle sheet can be composed of polyethylene, silicone treated paper, a cellophane strip, and the like and is generally of sufficient length and width to cover the self-seal area of the shingle strip under surface.

The tab segments of the shingle sheet in the present invention can be minimally spaced in the unitary shingle sheet as in, for example, U.S. Pat. No. 2,161,440, or, in the case of composite shingle, the tab segments are spaced between about 0.5 and about 1.5 times their width, however, between about 0.75 and about 1.25 spacing is most desired. In a specific embodiment the shingle sheet is of a length between about 3 to 5 feet for easy handling and preferably has a headlap portion height of from about 6 to about 8 inches with a butt portion height of from about 4 to about 6 inches to provide an overall height of about 10–14 inches. A dimensional ratio between the headlap and butt portions of about 6–7:5 is required to provide a headlap portion of critically greater height than that of the butt portion for a desired double layer shingle fabric installation.

Although the present invention includes a unitary shingle wherein courses of the above described shingle can be installed in overlapping arrangement and wherein the butt portions of one course overlap the headlap portions of the preceding course, a particular and preferred embodiment of the present invention, concerns a composite fiberglass roofing shingle comprising a rectangular fiberglass sheet having a headlap portion and a butt portion as above described, which butt portion is divided into a series of spaced apart tab segments. An elongated strip which is of substantially the same length, and preferably having substantially the same asphaltic coating thicknesses, as applied to the shingle sheet on its upper surface and on its unthickened under surface of the headlap portion, constitutes the remaining unit of the composite. The height, i.e. the width, of the strip is greater than that of the shingle sheet butt portion and is attached to the shingle sheet in a position underlying the tabs and the lower 1/7th to about 3/7ths area of the adjoining headlap portion, e.g. the lower 1 to 3 inch area of a 7 inch headlap portion in a preferred embodiment where 5 inch butt portion is employed. The strip, which fills the spaces between the tabs, is adhered to the shingle sheet, preferably along the underlapped lower headlap portion and the entire tab areas of the butt portion. However, it should be understood for the purposes of this invention, that a separate adhesive for the shingle sheet component of the composite need not be applied to the back coated layer and that adhesion may be accomplished by heating the shingle sheet back coating per se which possesses sealing properties. Accordingly, suitable adhesive materials include the asphaltic material used for coating, petroleum residue, asphalt adhesive modified with butyl rubber or any other inexpensive and weather resistant adhesive to which may be added mineral filler, low melt rubber, and/or plasticizers.

The strip of the composite shingle is composed of the same materials and layers as described above for the shingle sheet except that the under surface of the strip is coated with an asphaltic material of uniform thickness and carries, as in one particular design, a self-sealing area on its exposed undersurface which is longitudinally disposed along its lower marginal area.

Generally, the thickness of the strip asphaltic undercoat can be between about 5 and about 50 mils, preferably 5–20 mils. However, the undercoating of the strip can be about the same thickness as employed on the butt under surface of the shingle sheet. The strip is preferably mounted to the sheet in a manner such that its exposed edge is flush with the butt edge of the tabs; although, for a different visual effect, the tab butt edge may extend slightly beyond the exposed edge of the strip; for example, an extended butt edge of not more than one eighth inch is recommended to avoid damage to the tab end portions.

For installing overlapping courses of composite shingles the undersurface of the strip carries an adhesive strip which serves as the weatherproof bond between the overlapping courses of the composite shingle.

Assembly of the present shingle composite, produces an enhanced visual effect by emphasizing the vertical boundaries between the strip and the sheet at the points of contact and also increasing the height between the surfaces of the overlapping courses of the shingle composite. This arrangement provides for a slight upward extension at the forward butt edge of each course and thickened vertical boundaries between the tabs and the strip to provide a weathered wood shingle or slate slab shingle effect Deep random shadow lines add the character of a natural shake to the design.

It is to be understood that the forward butt edge of the tabs may be straight, irregular, or wavy and that the tabs can be similarly or irregularly spaced apart and can be of the same or different widths and shapes including square, rectangular or trapezoidal shapes. Also, the decorative granules on the shingle sheet can be applied in the same color or in mixed colors and the shingle sheet can be of the same or different hue from the shingle strip which is affixed thereto to provide lighter or darker shades of the roofing material in the recessed areas.

The composite shingle of the present invention presents numerous significant advantages over conventional asphalt shingles. The unique structure provided by the undercoating enables the achievement of a roof covering which presents an irregular, bulky tab profile and surface contour which compares favorably to the substantial and imposing architectural appearance of more expensive roofing materials. The improved appearance is achieved with a lighter composite shingle unit which permits easy handling and installation. Specifically, the headlap undercoat need not be perfectly finished and may be minimally applied since this area is protected from the elements by the overlapping courses. Since the thickened asphaltic backings are used only at the lower headlap area and tab segments, the weight of the shingle is lightened by the reduced asphalt application to the major area of the headlap portion.

Applying the thicker asphaltic coating on the undersurface of the butt portion rather than on the exposed weather surface of the butt portion eliminates granule pressing problems on an uneven top coating which can cause granule loss of weathering and an undesirable asphaltic coating bleed through the decorative granules in manufacturing. Also, with thicker back coating, a more balanced construction of the shingle butt portion is attained so as to provide good handling characteristics on installation and superior resistance to dimensional movement and distortions which enhances the long term weathering performance of the roofing shingle. However, a ratio of weathered surface coating to butt undercoating of 1:1 to 1:4 is also acceptable.

For installation, the courses employing the composite shingle or the unitary shingle, can be laid in a manner such that the tabs are vertically aligned in the successive courses or, preferably, that the tabs are offset between the spaces of a succeeding adjacent course. Thus, the present shingle enables substantial saving in time and labor upon installation as well as a significant decrease in wastage of material. Unlike the conventional asphalt shingle, the composite shingle of the present invention is structured for application in an irregular manner such that course after course may be installed without the necessity of continual adjustment to obtain proper alignment of tab segments. Finally, the unique method of producing the composite shingle provides its improved structure at the lowest possible cost since no scrap whatever is produced.

The shingles of this invention are produced by a novel process which comprises the steps of providing a rectangular sheet of a length at least equal to that of the finished shingle and a width equal to twice the headlap portion plus the height of the butt portion of the finished shingle, so that the rectangular sheet can be divided along a predetermined path to obtain two complementary segments, each segment having a headlap portion and a butt portion which includes a series of tabs extending from the headlap portion and being spaced apart from each other at a predetermined distance.

The undersurface of the rectangular sheeting, after coating upper and lower surfaces with asphaltic material in a thickness of from about 20 to about 100 mils, is doctored in a manner such that the central lngitudinal area conforming in height to the butt portion of a shingle and the area of from about 1/7th to about 3/7 ths beyond the boundaries of the central area is left with a thicker asphaltic deposit than the remaining marginal edge portions which form the upper and lower longitudinal edges of the rectangular sheet from which asphalt is removed to leave a layer of from about 5 to about 15 mils thickness. The surface of the thicker central portion is then smoothed to prevent ridges so that upon dividing the rectangular sheet as described in U.S. Pat. No. 3,921,358, FIGS. 5A and 5B, 2 shingle sheets each having uniformly elevated butt portions are obtained.

The manner of applying the asphaltic coating to the undersurface of the sheeting is crucial and involves an asphalt applicator roller partially immersed in asphaltic material which is contained in a coating pan and is located beneath the undersurface of the sheeting passing in a forward direction and rotating the asphalt applicator roller, preferably in a direction opposite the continuous forward passage of the sheeting material in the coating train so as to apply asphaltic material against the undersurface of the sheeting and creating a shearing action favoring adhesion of the thick asphalt coating to the undersurface of the sheeting. In this manner, a heavier asphaltic coating can be applied at the tangential point of contact between the sheeting and the asphalt applicator roller. The coating is then doctored, e.g. with a centrally notched doctor blade whose higher end portions at either side of the notch remove asphalt from the marginal edges of the sheeting which correspond to unthickened areas of headlap portions in a shingle sheet. The remaining, centrally located thicker portion is then passed over a smoothing bar for hydroplaning contact on the surface of the thicker asphalt deposit to assure a smooth thick coating which resists drip and spattering during high speed (e g. 200–500 feet/minute) processing.

CRITICALITY OF THICK BUTT AND MINIMAL HEADLAP ASPHALTIC UNDERCOATING IN COMPOSITE SHINGLE

A 4 foot length shingle sheet having a 7 inch height headlap portion and a 5 inch height butt portion, wherein 6 inch tab segments are spaced 6 inches apart is overcoated on its weather surface with 20 mils of asphalt in which decorative granules are partially embedded and undercoated with asphalt over the entire butt portion and 1 inch of the adjoining headlap portion in a thickness of 40 mils; the remaining 6 inch height of the headlap under portion being asphalt coated in a 10 mils thickness A 4 foot length shingle strip having a height of 6 inches and having a 20 mil thick asphalt coating on its upper surface and 10 mils thick asphalt coating on the under surface, is attached to the sheet in a position underlying the butt portion and 1 inch of the adjoining headlap portion by melting asphalt in the areas of contact to provide a continuous asphalt seal between the sheet and the strip.

Another 4 foot length of identical shingle sheet having a 7 inch height headlap portion and a 5 inch height butt portion wherein 6 inch wide tab segments are spaced 6 inches apart is overcoated as descrbed above and undercoated with asphalt over the entire butt portion and 0.25 inch of the adjoining headlap portion in a thickness of 40 mils; the remaining 6.75 inches of the headlap portion being asphalt coated in a thickness of only 10 mils.

A 4 foot length shingle strip having a height of 5.25 inches and 20 mils thick asphalt coating on its upper surface and 10 mils on its under surface is sealed to the sheet underlying the butt portion and 0.25 inch of the adjoining headlap portion in the manner described above.

Each of the above composite shingles is subjected to natural weathering over a period of 2 years by side-by-side exposure to the elements Seal failure between the sheet and the strip due to water seepage, freezing and thawing conditions, UV exposure, etc. is noted in the composite shingle wherein only 0.25 inch of the headlap portion is thickly coated and sealed to the strip. The composite shingle having 1 inch of its headlap portion thickly underocated and sealed to the strip in a 1 inch headlap area, shows no sign of failure.

The same failure as in the above case of the composite shingle having only 0.25 inch of its headlap portion underlapped by the strip also results when the strip is extended to a height of 6 inches and is sealed to the sheet only in the butt portion and the 0.25 inch area of the adjoining headlap portion. It is also noted that in handling the product shingles of this comparison, as is normally encountered in roof installation of these products, the shingles with 0.25 inch overlap between the shingle sheet and the shingle strip shows several delamination failures at the overlap joint of the component parts which give access to water infiltration, particularly from wind driven rain; whereas the shingles with 1 inch overlap remain intact. Thus, the criticality of applying the thicker undercoat to the butt portion and at least 1/7th of the adjoining headlap portion of the shingle sheet in the present shingles is established.

When the thicker undercoat is extended to include more than 3/7ths of the adjoining headlap portion, the weight of the shingle is undesirably increased without any significant improvement in weathering.

BRIEF DESCRIPTION OF THE DRAWINGS

FIGS. 3 represents a side sectional view of the shingle sheet shown in FIG. 1; FIGS. 3A and 3B show a side sectional view of the composite shingle after assembly of the shingle sheet and shingle strip.

DESCRIPTION OF THE PREFERRED EMBODIMENTS

Figure 1:
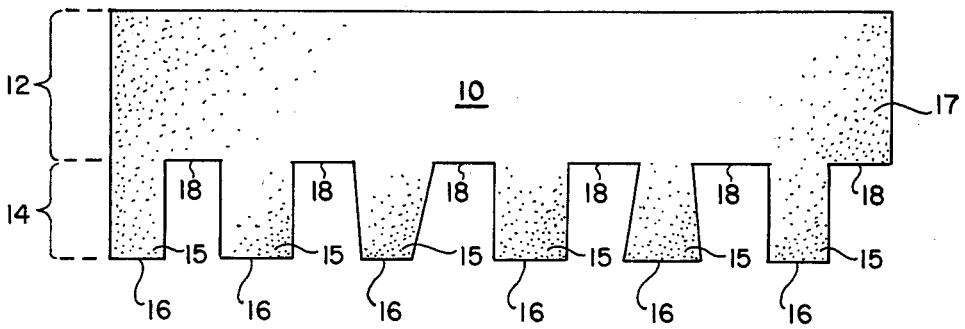
FIG. 1 is a plan view of the headlap-butt portion of the shingle sheet in the composite shingle.
Figure 2:
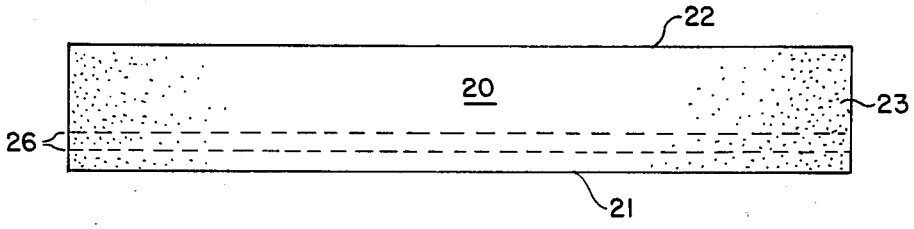
FIG. 2 is a plan view of the strip portion of the shingle composite.

A preferred embodiment of the present invention is a composite roofing shingle which comprises shingle sheet 10 as shown in FIG. 1 and shingle strip 20 as shown in FIG. 2. Shingle sheet 10 is composed of headlap portion 12 and butt portion 14, which butt portion is longitudinally divided into space separated tabs 15 which are integral with and extending from headlap portion 12. Tabs 15 are spaced apart from each other at disimilar distances which represent 0.75 to 1.25 the width of the tabs and the spaces which separate tabs 15, extend continuously from the headlap portion 12 to the exposed longitudinal marginal edge 16 of tabs 15. In general, the aggregate width of tabs 15 is approximately equal to the aggregate width of spaces therebetween. Tabs 15 may be of equal or different widths and of rectangular trapezoidal or other desired shape variations of which are shown in FIG. 1. The weather surface of sheet 10 is coated with colored mineral granules 17. The lower marginal edge of headlap portion 12 is defined by 18 which represents the boundary between the headlap portion and the butt portion.

Shingle strip 20 is shown in FIG. 2 as having a lower longitudinal marginal edge 21 and an upper marginal edge 22. The upper weather surface of strip 20 is also coated with colored mineral granules 23. The self-sealing area on the undersurface of strip 20 is indicated by dotted lines 26.

Figure 2A:
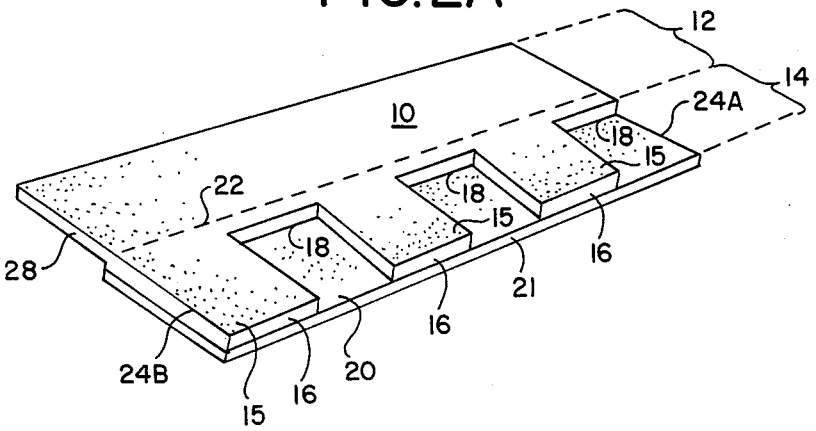
FIG. 2A is a perspective view of the assembled composite shingle of FIGS. 1 and 2.

FIG. 2A illustrates the assembled composite shingle including shingle sheet 10 and shingle strip 20. In FIG. 2A strip 20 is secured to sheet 10 in a position underlying tabs 15 and filling spaces between. At least a portion of the lower marginal edge 21 of strip 20 coincides with the exposed longitudinal marginal edge 16 of butt portion 14 and tabs 15. The lower marginal edge 18 of headlap portion 12 slightly overlaps the upper marginal edge 22 of strip 20 and is secured thereto by asphaltic adhesive or other suitable means to insure a water tight seal between sheet 10 and strip 20. Each tab 15 is also secured to strip 20 by adhesive or other suitable means. As shown in FIG. 2A, the undercoating 28 of shingle sheet 10 is of varying thickness such that a significantly major area of headlap portion 12 is coated with an asphaltic material having a thickness of from about 1/20th to about ¼th the thickness of butt portion 14 and the lower section of headlap portion 12 where the upper longitudinal marginal edge 22 of strip 20 underlaps the lower section of headlap portion 12.

Figure 4:
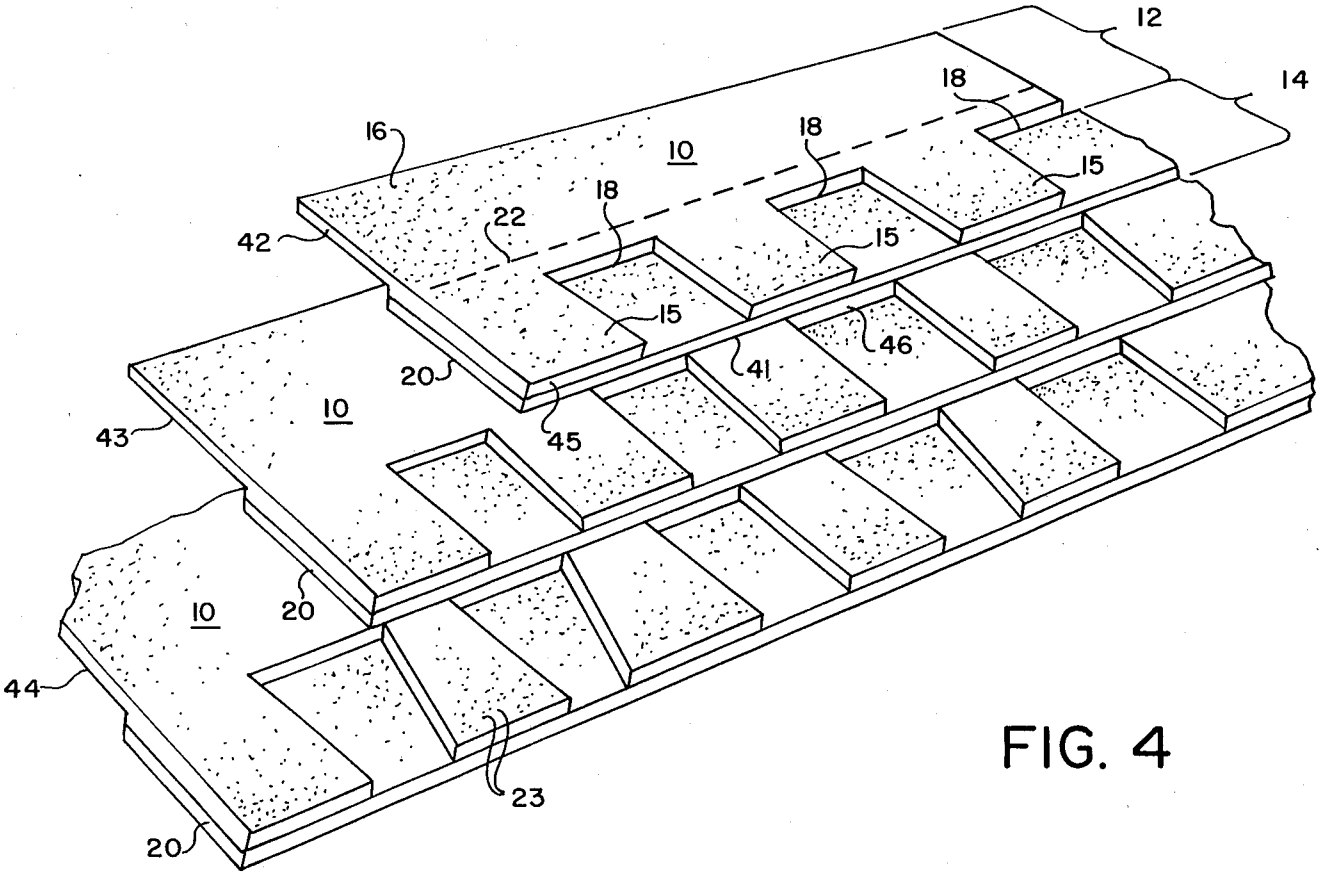
FIG. 4 is a perspective view of a section of roof layed with the preferred composite shingles of the present invention.

This construction provides a shingle having an accentuated and uniformly uplifted butt portion of irregular surface contour with respect to strip 20 and an undercoated butt portion 14 of a substantially increased thickness as compared to the minimally undercoated headlap portion 12. The irregular surface contour is also accentuated between overlapping courses of the shingle, as shown in FIG. 4, wherein the uplift of the entire butt portion, including the area where the butt and headlap portions join 18, creates the illusion of individually mounted wood or slate shingles. Additionally, one transverse marginal edge 24A of butt portion 14 is of a single thickness as defined by a transverse marginal edge of underlying strip 20 and the opposite transverse marginal edge 24B of butt portion 14 is of more than double thickness as defined by the coincidence of a transverse edge of a tab 15 and the opposite transverse marginal edge of strip 20.

A further advantage of the embodiment shown in FIGS. 1–2A is that two shingle sheets, for example, the shingle sheet 10 of FIG. 1 and its counterpart can be made from one large rectangular sheeting piece which is equal in length to sheet 10 and strip 20 but wider by a dimension equal to the height of a headlap portion. When the larger piece is treated according to the process outlined above, wherein a central area of thicker asphalt backing is provided, the sheeting piece is cut so that the tabs of one sheet are formed from the spaces between the tabs of the other sheet thus the amount of material and number of treating steps necessary to obtain the advantages of the present shingle having an asphaltic back coating of varying thickness, is not significantly greater than the amount required to make a single shingle.

To more clearly define the layered arrangement of the present shingles, reference is had to FIG. 3 of the drawings. As shown, substrate 30 is coated with an asphaltic material to form layer 32 of asphaltic coating on the upper or weather surface of substrate 30. This coating may have a thickness of between about 15 and about 60 mils, preferably between about 20 and about 50 mils. The coated weather surface of substrates 30 carries embedded decorative granules 33 on its exposed weather surface. The butt and headlap portions of shingle 11 are also shown in FIG. 3. The underside of shingle sheet 11 is undercoated with asphaltic material of varying thickness, 34. As noted above, the entire butt portion and the lower marginal area of the headlap portion is coated with said asphaltic material in a thickness of between about 20 and about 100 mils, preferably between about 25 and about 75 mils; whereas the asphaltic coating on the remaining headlap portion is significantly thinner, having a thickness of between about 5 and 15 mils, preferably between about 7 and about 12 mils. The undercoating of the shingle sheet carries a thin layer of non-cementitious material indicated by layer 35 and may additionally carry a release tape, 36 longitudinally disposed along the upper longitudinal area of the headlap portion to coincide with the sealing strip on the underside or non-weather side of the shingle strip after attachment in an underlying position to shingle sheet 11.

FIGS. 3A and 3B show a side sectional view of the composite shingle after assembly of shingle sheet 11 with shingle strip 21. The numbers of the laminated layers correspond to those indicated in FIG. 3 The side views of the composite shingle are identical, except that FIG. 3B is reversed and up-ended to illustrate advantages in packing and to show the placement of the release strip 36 and 36' disposed to overlap the adhesive strip 38 and 38' on the under surface of the shingle strip. The adhesive strip 38 and 38' serve to seal overlapping courses of composite shingle upon installation.

It is readily seen that the shingle strip is composed of the same layers as the shingle sheet; thus, granule embedded asphaltic shingle sheet layer 32 corresponds to shingle strip layers 2 and 2' in which decorative granules 3 and 3' are respectively embedded Shingle sheet substrate 30 corresponds to shingle strip substrate 4 and 4'; shingle sheet undercoat 34 corresponds to shingle strip undercoat 5 and 5', except that the undercoating on the strip is of uniform thickness, and the non-cementitious layer 35 of shingle sheet 11 corresponds to the non-cementitious layer 6 and 6' of the shingle strip. Longitudinally disposed along the lower portion of shingle strips 21 and 21', is located an adhesive strip 38 and 38'.

By the above back-to-back and up ended arrangement it is readily apparent that shingles packed in the position, as shown in FIGS. 3A and 3B, resist adhesion during handling and shipment before being installed. The correspondence in positioning the respective release strips and sealing strips is shown by dotted lines between FIGS. 3A and 3B.

FIG. 4 illustrates a roof covered with a plurality of successive offset courses of rectangular composite shingles according to the embodiment of FIG. 2A. In this embodiment the single thickness butt portion of each composite shingle of a given course a abutts the double thickness transverse marginal edge of the adjacent shingle of that course. As illustrated, the shingles of course 42 are offset from the shingles of the immediately subadjacent course 43 by a first longitudinal distance and the shingles of course 43, are in turn, offset from the shingles of an immediately subadjacent course 44 by a second longitudinal distance, the first and second longitudinal distances being unequal to each other. Unlike conventional shingles, the present may be offset from each other at any distance less than the length of a shingle and such distance may be varied at random without adversely effecting the quality and appearance of the ultimate roofing covering. Variations of surface contour on a roof of the present shingles are particularly evident in FIG. 4 wherein the exposed lower edges of the butt portion of successive courses are of a thickness equal to the shingle strip at 41 at least double at 45 and tripled at 46. Since the thickness of the tab segments in each butt portion is significantly greater than that of the underlying shingle strip, the elevation of tabs at 45 and 46 is markedly increased for a distinctly irregular and bulky butt edge profile which compares favorably to the appearance of more expensive roofing.

Figure 5:
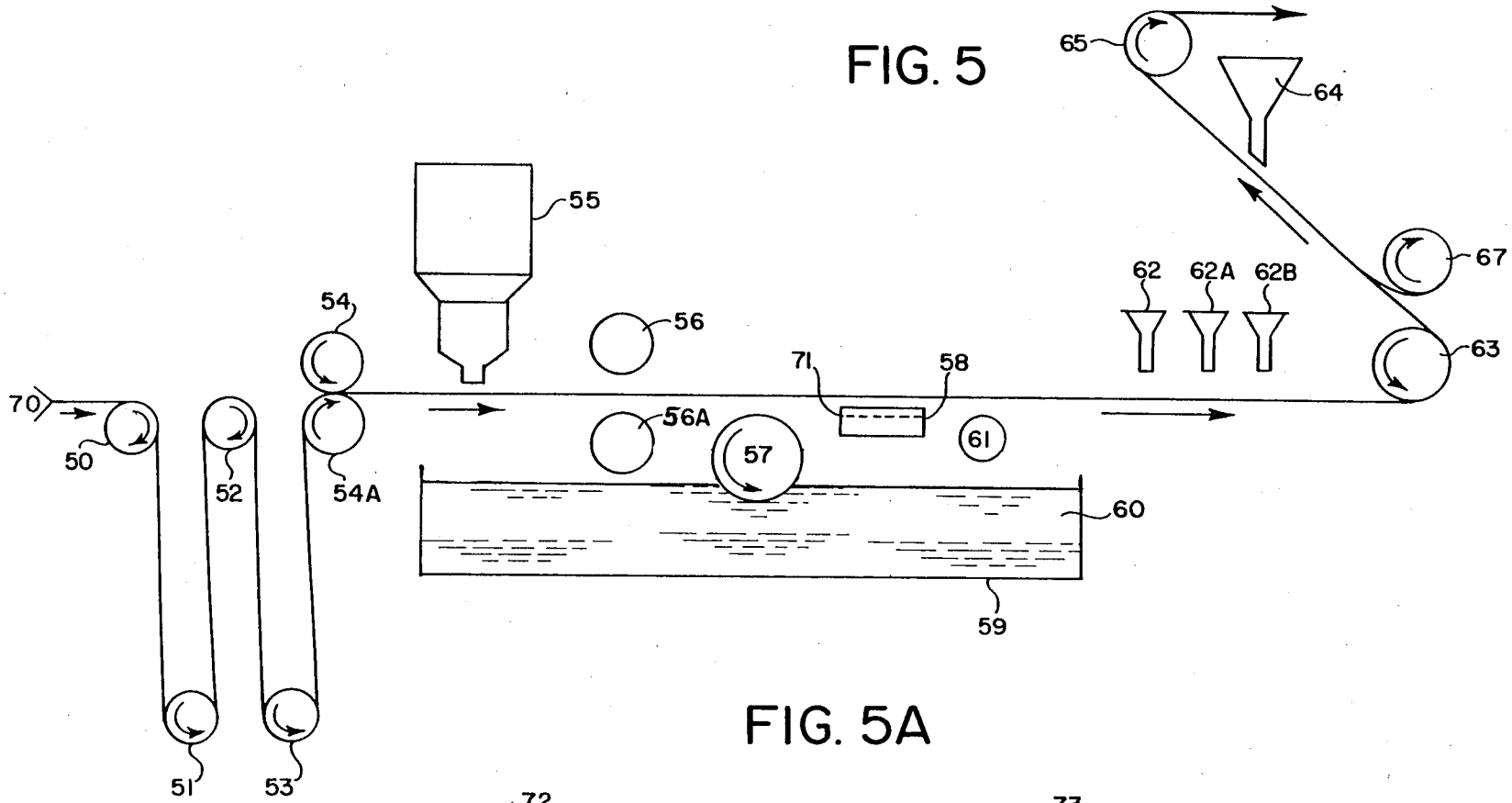
FIG. 5 is a diagramatic view showing an arrangement of apparatus used in the novel process for preparing the composite shingles of this invention.

A specific and preferred method for manufacturing the shingle of this invention is shown in FIG. 5 which provides a diagrammatic arrangement of apparatus and linear passage of the shingle sheet in the process of its manufacture. This process involves passing rectangular sheeting 70, comprising a glass mat or asphalt impregnated felt sheeting, from which 2 shingle sheets are subsequently formed, over a series of loopers 50–53 and between a pair of tension rollers 54 and 54A to provide uniform tension of the sheeting being processed The sheeting is then passed to the coating stage where a layer of asphaltic coating is supplied to the upper surface thereof from feed tank 55. After surface coating, the sheeting is passed between doctoring rollers 56 and 56A. Asphalt applicator roller 57 applies an asphaltic coating of from about 20 to about 100 mils to the under surface of the sheeting and is partially immersed in heated reservoir 59 containing liquified asphaltic material 60 which is picked up by roller 57 and deposited on the under surface of substrate sheeting 70. Downstream of roller 57 there is mounted an adjustable notched doctor blade 58, which functions as a metering device for altering the thickness of the asphaltic coating on the under surface of the sheeting and proportions it accordingly in pre-determined areas corresponding to the headlap and butt portions of the shingle sheets and allows return of excess asphaltic material from marginal areas of the sheeting to reservoir 59. The blade of doctor blade 58 is vertically positioned under the sheeting and is centrally notched on its upper vertical edge so as to remove and return excess asphaltic coating material, i.e. that in excess of 5–15 mils, from the transverse marginal edges of the sheeting, each of which conform to the thinner undercoated portion of one composite shingle. The sheeting has been coated on the upper and under surfaces and doctored to the desired undercoating thicknesses is then passed over smoothing bar 61 which is adjusted to hydroplane on the central thickened portion of the sheeting and to smooth the surface thereof. The sheeting is then passed below a series of granule applicators 62, 62A and 62B from which decorative granules are deposited on the upper surface of the sheeting and embedded in the asphaltic layer by means of top surfacing drum 63. The sheeting can be then passed to back surfacing applicator 64 from which non-cementitious particles are dusted on the undersurface of the sheeting and finally over back surfacing drum 65 from which the final sheeting product is removed. Additionally a release tape from roller 67 can be adhered along the undersurface of the sheeting in marginal areas deployed so as to contact an adhesive sealing area, which is applied to the marginal undersurface of the shingle strip after assembly in a composite shingle and positioned for shipment as shown in FIGS. 3A and 3B, taken in combination.

Figure 5A:
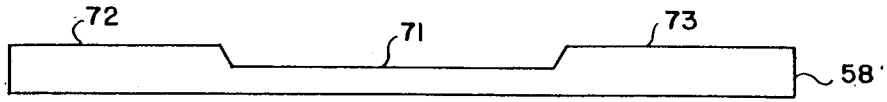
FIG. 5A is a side view of a notched doctor blade used in the process for the manufacture of the present shingles.

The sheeting can then be cut along a predetermined pat as shown in FIGS. 5 and 5A of U.S. Pat. No. 3,921,358, to provide two complementary shingle sheets, each having headlap and butt portions of identical heights and of desired asphaltic undercoating thicknesses. A sharper cut through the butt portion of the present shingle sheeting is achieved due to the increased thickness of the asphaltic undercoat. Thus, the visual exposed edges of the tab segments have a smoother appearance and are more resistant to tear.

The shingle strip which is subsequently attached to the shingle sheet is manufactured in a similar manner except that doctor blade 58 is not notched, and smoothing bar 61 can be eliminated. It is to be understood that separate application of laminating adhesive to the under surface of the shingle sheet for attachent to the shingle strip is not required and is preferably not used, since lamination of the shingle components can be easily achieved by using the adhesive properties of a heated asphalt backing when joining units of the composite shingle.

FIG. 5A shows a side view configuration of doctor blade 58 which is perpendicularly positioned across the path of the rectangular sheeting. Notched portion 71 is located centrally of the blade and critically occupies a position greater than the equal unrecessed portions 72 and 73 of blade 58.

The embodiments described and shown in FIGS. 1–5A are not to be construed as limiting to the scope of the invention as more broadly defined above and in the appended claims.

What is claimed is:

1. The process which comprises topcoating a fibrous shingle substrate, having a shingle upper headlap portion and an adjoining lower butt portion, with an asphaltic material in a thickness of from about 15 to about 60 mils; partially embedding decorative, weather resistant granules on the exposed surface of said topcoating; undercoating the entire butt portion and between about 1/7th and about 3/7ths of the adjoining headlap portion with an asphaltic material in a thickness of from about 20 to about 100 mils, undercoating the remaining headlap portion with asphaltic material in a thickness of from about 5 to about 15 mils and contacting said thicker undercoating with a bar which hydroplanes on the surface of the thicker undercoating to smooth said surface.

2. The process of claim 1 wherein the thicker undercoating on the butt portion and having about 1/7th and 3/7ths of the adjoining headlap portion of the substrate is between about 1/20th and about ¼th thicker than the thinner undercoating on the remaining headlap portion.

* * * * *